United States Patent [19]

Duill et al.

[11] Patent Number: 4,728,044

[45] Date of Patent: Mar. 1, 1988

[54] APPARATUS FOR THE COMMINUTION AND GRINDING OF BRITTLE GRINDING STOCK, PARTICULARLY OF DAMP INITIAL MATERIAL

[75] Inventors: Helmut Duill; Josef W. Brummer, both of Cologne, Fed. Rep. of Germany

[73] Assignee: Klöckner-Humboldt-Deutz Aktiengesellschaft, Fed. Rep. of Germany

[21] Appl. No.: 924,457

[22] Filed: Oct. 29, 1986

[30] Foreign Application Priority Data

Oct. 29, 1985 [DE] Fed. Rep. of Germany ..... 3538385
Dec. 18, 1985 [DE] Fed. Rep. of Germany ..... 3544798

[51] Int. Cl.[4] ..... B02C 23/38

[52] U.S. Cl. ..... 241/18; 241/23; 241/24; 241/29; 241/61; 241/62; 241/78; 241/580; 241/152 A

[58] Field of Search ..... 241/24, 29, 18, 80, 241/97, 60, 14, 23, 61, 62, 152 A, 78, 57

[56] References Cited

U.S. PATENT DOCUMENTS 1,864,973 6/1932 Buchanan ..... 241/152 A
3,942,727 3/1976 Fahlstrom et al. ..... 241/80 X
4,592,512 6/1986 Grigel et al. ..... 241/29 X

FOREIGN PATENT DOCUMENTS 0084383 4/1983 European Pat. Off. .
1281817 10/1968 Fed. Rep. of Germany ... 241/152 A
220510 4/1985 Fed. Rep. of Germany ... 241/152 A
3337615 4/1985 Fed. Rep. of Germany ... 241/152 A

OTHER PUBLICATIONS

Tandem Grinding Drying System, 1977.

*Primary Examiner*—Mark Rosenbaum
*Attorney, Agent, or Firm*—Hill, Van Santen, Steadman & Simpson

[57] ABSTRACT

For reducing the specific energy outlay in the grinding-drying of damp initial material, a circulating grinding system including a comminution machine, particularly an impact hammer, which is followed, via a sifter, by a high-pressure roll press operated in accord with the principle of product bed comminution, whereby the product admission of an impact hammer mill is connected to the feed for fresh initial material and the product discharge of a roll press is in communication with a product admission and/or with a product discharge of an impact hammer mill.

17 Claims, 2 Drawing Figures

APPARATUS FOR THE COMMINUTION AND GRINDING OF BRITTLE GRINDING STOCK, PARTICULARLY OF DAMP INITIAL MATERIAL

BACKGROUND OF THE INVENTION

The invention relates to improvements in apparatus for the comminution and grinding of brittle grinding stock such as raw cement meal, cement clinker, ore, coal or the like, and particularly comminution of material which is damp before grinding.

What is referred to as a "tandem grinding-drying system" ("Cement-Data-Book" by Duda, Second Edition, 1977, page 101) has been disclosed for grinding and simultaneous drying of damp material for the manufacture of raw cement meal wherein a tube mill i.e., a ball mill is preceded by an impact hammer mill and both mills are traversed by a hot gas stream. Raw material up to 100 mm particle size and up to about 12% moisture can be ground into raw cement meal extremely well and dried with this known system upon employment of hot exhaust gas from the raw cement meal pre-heater. However, the energy exploitation of the ball mill thereby utilized is not very satisfactory.

Considerable efforts have been undertaken in order to enhance the low energy exploitation in the comminution machines, particularly in the tube mills. Thus, a two-stage means for comminution and grinding of brittle grinding stock has been disclosed (European Patent Application No. 0 084 383) wherein the non-pre-comminuted grinding stock, such as, lumps of cement clinker, are first pressed under high pressure in the nip of a high-pressure roll press in the first stage. This partly leads to particle destruction, partly due to the production of incipient cracks in the interior of the particles and being visibly expressed in the formation of agglomerates which are then disagglomerated or destroyed in the second stage in a tube mill or a ball mill with comparatively low energy outlay and can then be ground to finished product fineness. In the material pressing, a roll press operated with a high pressing power of more than 2 t/cm of roller length produces agglomerates whose grindability is considerably improved compared to unpressed material, so that the two-stage comminution leads overall to a noticeable reduction of the specific energy requirement. In the roll press, the individual particles of material are mutually crushed in a product bed, i.e., in a material fill compressed between two surfaces, so that what is referred to as product bed comminution occurs in the first stage.

With known grinding means preceding a high-pressure roller press, this can be non-uniformly loaded when the grain size distribution of the feed stock is extremely non-uniform, this being the case with initial material for raw cement meal. The grain size of this initial material can fluctuate within a range from 0 to more than 50 mm and above. The risk is present that the high-pressure roll press will run erratically. The initial material for raw cement meal is usually damp, having an initial moisture up to about 15%, and since this material must not only be ground, but must also be dried, there is also a need to utilize a high-pressure roll press with product bed comminution in a grinding-drying operation, and this has not been proposed or realized previously.

Given a comminution or grinding apparatus of the type referred to, an object of the invention is to insure that the high-pressure roll press utilized receives a feed stock having a somewhat uniform grain size distribution and that the high-pressure roll press with product bed comminution can be integrated in a grinding-drying of damp material in a meaningful way.

Employing a two-stage comminution and grinding in accordance with the invention using a high-pressure roll press or roll-jaw crusher with a further comminution machine, particularly an impact hammer mill, the two comminution machines are interconnected to form a circulating grinding system via a classifier, and particularly a sifter. The fresh initial material to be comminuted is not delivered to the high-pressure roll press, but to the other comminution machine, preferably an impact hammer mill, which can comminute feed stock having a grain size distribution from 0 through about 80 mm. This is followed by the high-pressure roll press. A sifter is inserted between the impact hammer mill and the roll press, the sifter separating the adequately fine fraction (about 20 through 30%) already contained therein from the product discharge of the impact hammer mill as finished product. Only coarse sifter material (grits) proceed to the product admission of the high-pressure roll press, the grain size distribution thereof being uniform and the absolute grain size being small in comparison to the fresh initial material which is supplied to the impact hammer mill. In the comminution and grinding apparatus of the invention, therefore, the high-pressure roll press can be operated free of sudden load, being always uniformly operated with an optimally set roll pressing power of, for example, 6–9 t/cm of roller length. The product discharge of the roll press is in communication with the product admission and/or with the product discharge of the impact hammer mill. When the roll press discharge, which can be composed of agglomerates, is supplied to the product admission of the hammer mill together with the fresh initial material, then the easily crumbling agglomerates of the press are disagglomerated by the impact hammer mill without additional cost expenditure. When the roll press discharge by-passes the impact hammer mill and is introduced into the product discharge thereof, then the product agglomerates are disagglomerated in the rising main arranged between impact hammer mill and sifter and/or in a corresponding product admission sluice such as, for example, a tube worm.

The invention can be particularly well applied in grinding-drying of fresh, damp material, such as initial material for raw cement meal. Using the grinding-drying installation of the invention, a hot gas conduit is connected to the product admission of the impact hammer mill equipped with a closed bottom and a rising main is arranged between the product discharge of the impact hammer mill and the sifter being fashioned as a flow dryer. The coarse sifter product (grits) returned from the sifter to the high-pressure roll press has been dried to such a great degree that the product bed comminution of this coarse sifter material in the nip of the roll press is not impeded by the slight residual moisture which may still be present. Especially characteristic of the grinding-drying system of the invention for comminution and grinding of damp material is that the tube mill or ball mill which had hitherto always been utilized in grinding-drying systems and which is distinguished by an extremely poor energy exploitation is no longer present. It is replaced by a high-pressure roll press operated in accord with the principle of product bed comminution. This results in a considerable reduction of the capital costs as well and primarily in a reduction of the specific energy requirement of the overall grinding-drying system. It is also easily possible to remodel existing grinding-drying systems into the grinding-drying system of the invention after elimination of the tube mill or ball mill in order to benefit from the extremely high energy savings during operation of the grinding-drying system of the invention.

The advantages, features and objectives of the invention will become more apparent with the teaching of the principles of the invention in connection with the disclosure of the preferred embodiments thereof in the specification, claims and drawings, in which:

DESCRIPTION OF THE PREFERRED EMBODIMENTS

Figure 1:
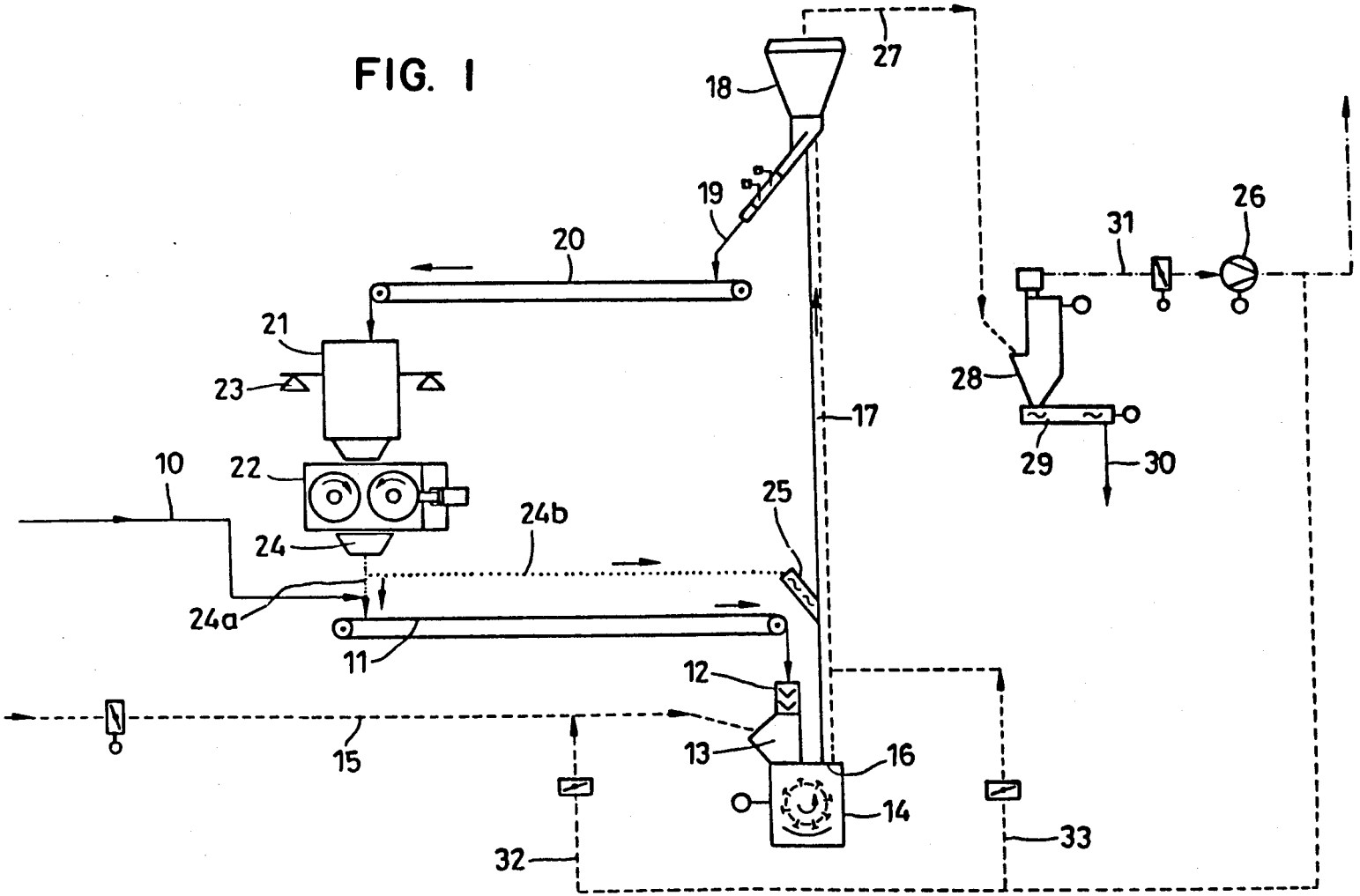
FIG. 1 is a diagrammatic showing of a system essentially illustrating a flow diagram of an arrangement embodying the principles of the present invention.

The embodiment of FIG. 1 shows a flow chart of a grinding-drying system of the invention for grinding and drying damp initial material for the manufacture of raw cement meal. The initial material is pre-comminuted by a primary crusher and has a grain size distribution from 0 to about 80 mm and a moisture up to about 20%. The material is delivered onto the admission end of a belt conveyor 11 or metering conveyor-type weigher or the like via an admission means 10, and is introduced into a product admission opening 13 of an impact hammer mill 14 with a closed floor, being introduced thereinto via a material sluice 12, such as a double pendulum type sluice.

A hot gas conduit 15 (indicated with broken lines) is connected to the product admission opening 13 of a mill 14. Exhaust gas of a pre-heater for raw cement meal of a cement clinker burning system or hot exhaust air of a cement clinker cooler or/and hot gas of some other hot gas generator can be employed for hot gas. The hot gas is delivered via the conduit 15 and flows through the impact hammer mill 14 in which the initial material is pre-comminuted and pre-dried.

A rising main 17 fashioned as a flow dryer is connected to the product discharge 16 of the impact hammer mill 14, the product being further dried therein and this rising main 17 leads to an air-stream sifter 18 whose discharge conduit 19 for the coarse product (grits) is in communication with a delivery stack 21 of a high-pressure roll press 22 via a conveyor 20. The optimally dry coarse sifter product shown at 19 which is uniform in terms of its grain size distribution and is comminuted in the nip between the rollers of the high-pressure roll press 22, being comminuted therein by means of a product bed comminution. For this purpose, the coarse sifter product 19 is supplied to the nip of the press 22 in such a great quantity via the vertical stack 21 arranged above the nip that the product to be comminuted which is drawn in between the rollers presses the rollers apart and the particles of the feed stock mutually crush one another in the nip in a fill that is, in a product bed. The pressing power of the rollers of the roll press 22 acting on the product amounts to more than 2 t/cm of roller length, for example, 6–9 t/cm. In order to guarantee that the delivery stack of the roll press 22 is always fully filled with coarse sifter material 19, the delivery stack can be arranged on a weighing means such as, for example, pressure pick-ups 23 or the like.

The product discharge 24 of the roll press 22 emerges from the nip more greatly comminuted and partially agglomerated, i.e. pressed to form scabs which can be crumbled by hand and which already contain a considerable proportion of particles already reduced to the desired finished product fineness (finished raw cement meal). The discharge material 24 of the press is shown in the drawing as dotted lines **24*a* and 24*b*. The discharge material 24 of the press is in communication with the product admission 13 of the impact hammer mill 14 via the line 24*a* and/or is in communication with the rising main 17 via the line 24*b*** (conveying member).

When the discharge material 24 of the press proceeds into the impact hammer mill 14 via line **24*a*, then the latter has at least three simultaneous functions: It serves the purpose of pre-comminution of the fresh initial material 10, of drying the damp material and of disagglomeration and of post comminution of the agglomerates of the discharge material 24 of the press before the material proceeds into the rising main 17 serving as flow dryer. There is also the possibility of having the roll press discharge 24 enter into the rising main 17 via the line 24*b* via a sluice such as, for example, a tube worm 25. The material sluice 25 serves, first, for the disagglomeration of the discharge material 24*b* of the roll press and, second, serves for preventing the entry of air leaked into the rising main 17 in which a negative pressure of about 350 through 400 mm water column prevails due to the upward draft ventilator 26. There is also the possibility that the product discharge 24 of the roll press 22 can be divided into two fractions by means of a classifying sieve (not shown), the fine fraction 24*b* thereof leading to the rising main 17 and the coarse fraction 24*a* thereof leading to the product admission 13 of the impact hammer mill 14. Should the discharge material of the roll press be introduced directly via the line 24*b* into the rising main 17 be inadequately disagglomerated upon entry into the rising main 17, this would not be disadvantageous because the coarser grains or agglomerates which would initially not be pneumatically upwardly conveyed in the rising main 17, and would descend down and proceed into the impact hammer mill 14 where they would ultimately be comminuted to such degree so as to be carried up to the sifter 18 in the rising main 17** suspended in the drying gas.

A fine product discharge line 27 of the sifter 18 leads to a separator such as a filter 28, separating cyclone or the like which, via a conveyor 29, for example, a worm conveyor. This separator separates the fine material from the sifter gas stream or drying gas stream 31 and the fine finished material 30 emerges as completely dried and ground cement raw meal. The exhaust conduit 31 is in communication with the hot gas conduit 15 via a branch conduit 32, and/or is in communication with the rising main 17 which is connected to the product discharge 16 of the impact hammer mill 14. The conduit 32 is in communication with main 17 via a branch conduit 33. Gas quantity throttle elements are shown schematically in the gas-carrying conduits.

In a conventional grinding-drying system having a preceding impact hammer mill and following ball mill, the specific energy requirement for the finished product amounts to about 1.5 kWh/t at the impact hammer mill and about 12 kWh/t at the ball mill on average. Given the grinding-drying system of the invention which includes a preceding impact hammer mill and a following high-pressure roll press, the specific energy requirement at the impact hammer mill amounts to about 1.5 through 5 kWh/t and amounts to about 6 kWh/t at the roll press. It can be stated in general that with the grinding system of the invention, the energy saving in kWh/t becomes all the higher the poorer the grindability of the respective initial material to be ground.

Figure 2:
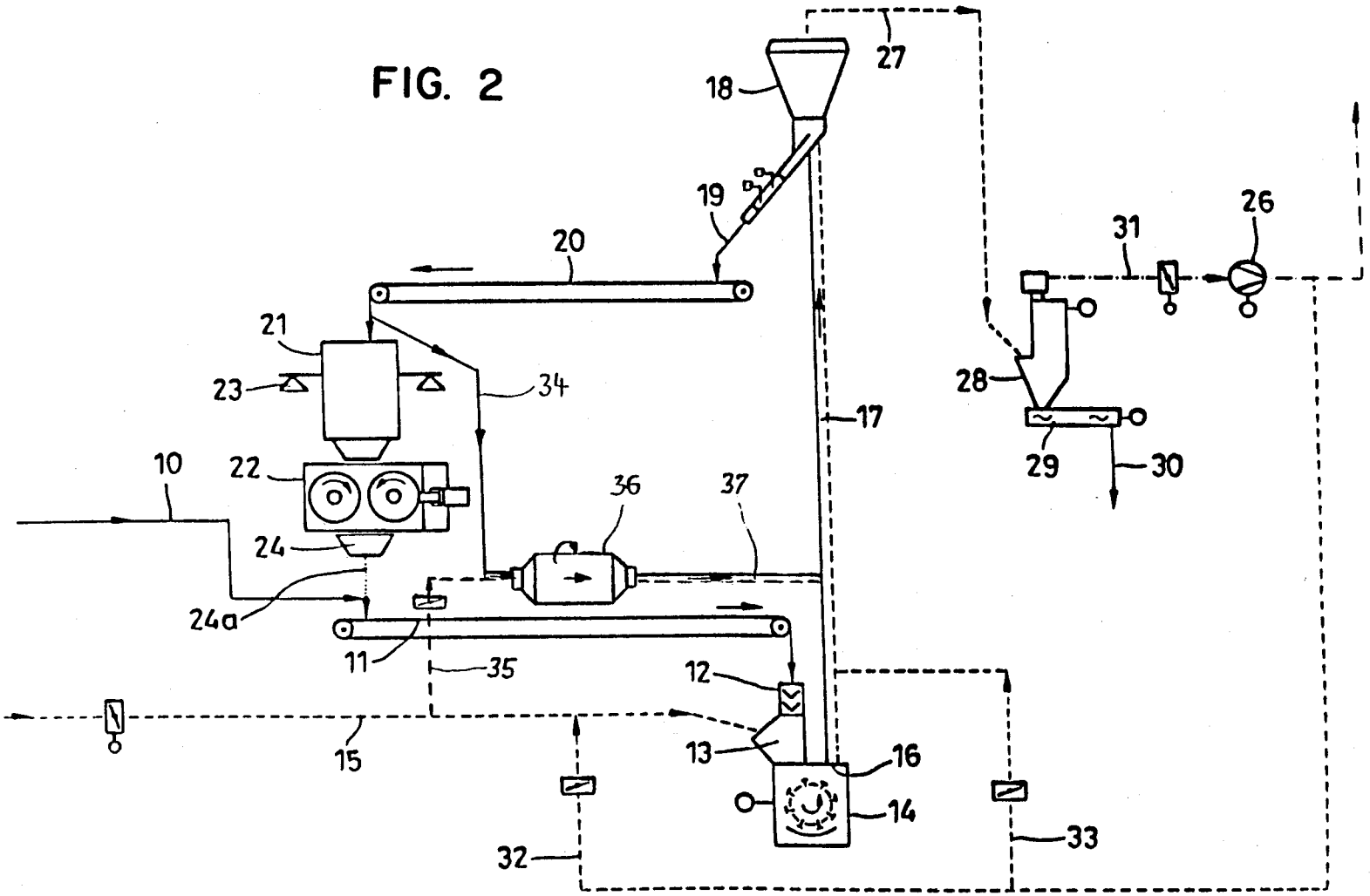
FIG. 2 is a diagrammatic showing similar to FIG. 1, but illustrating a modified form of the invention.

The embodiment of FIG. 2, wherein parts identical to parts in FIG. 1 are provided with the same reference numerals, shows a flow chart of a grinding-drying system of the invention for grinding and drying damp initial material 10, namely, coal. The coal has a composition of 30 wt. % anthracite, 70% hard coal and has a moisture of about 10% for the manufacture of dry coal dust. The coal leaves the system as a finished product 30 having a grain fineness 92% below 90 μm, i.e., having a higher fineness than raw cement meal. In the embodiment of FIG. 2, the possibility is established of branching off a sub-stream of the coarse material (grits) coming from the sifter 18 past the high-pressure roll press 22, such as, via an overflow at the delivery stack, via conduit 34, also a hot gas stream 35 can be branched off from the hot gas conduit 15, composed of hot flue gas or hot exhaust gas of a cement clinker burning installation. The gas thus exhibits inert gas properties, and is introduced into a tube mill or ball mill 36, and after the treatment in this tube mill, is conveyed via conduit 37 into the rising main 17 leading to the sifter 18. Due to the tube mill 36 being added in the embodiment of FIG. 2 in comparison to FIG. 1, this tube mill 36 being comparatively small in volume, the materials circulation rate conducted through the high-pressure press 22 is also reduced and the roll press is relieved. The following is a preferred example specified as a quantitative through-put example relating to FIG. 2:

| | |
|---|---|
| Damp feedstock 10 | 60 t/h |
| Roll press throughput 24a | 90 t/h |
| Quantity of material delivered to the Impact hammer mill 14 on belt conveyor 11 | 150 t/h |
| Quantity 34 of coarse sifter material branched off and throughput quantity through the tube mill 36 | 60 t/h |
| Quantity of material conveyed pneumatically up to the sifter 18 in the rising main 17 | 210 t/h |
| Quantity of coarse material (grits) departing the sifter 18 at 19 | 150 t/h |
| Quantity of fine material or, respectively, quantity of finished material or, respectively, 30 departing the sifter 18 | 60 t/h |

The grinding system of the invention can also be operated with cool gas instead of being operated with drying gas insofar as the initial material 10 is not damp but hot and is to be cooled during grinding, as for example with hot cement clinker, blast furnace slag or the like. When the initial material to be ground does not have to be dried or cooled, the grinding system of the invention can also be operated without an air stream. Then, the impact hammer mill 14 must include a sieve grate at the bottom and must allow the grinding stock to emerge downwardly and this, instead of being pneumatically conveyed, must be mechanically conveyed up to the sifter 18 via, for example, a bucket elevator. Some other comminution machine, such as, a cone crusher or the like, could also be used instead of the downwardly open impact hammer mill.

Thus, it will be seen that there has been provided an improved apparatus for comminution and grinding of brittle grinding stock which meets the objectives and advantages above set forth and which accomplishes improved economy and efficiency and can achieve an improved product.

We claim as our invention:

1. A grinding system for the comminution and grinding of brittle grinding stock selected from the group consisting of initial material for raw cement meal, cement clinker and coal including damp initial materials comprising in combination:

a comminution mechanism;

supply means for supplying an initial grinding stock to said comminution mechanism;

a comminution product discharge conduit connected to said comminution mechanism;

a classifier connected to receive the output from said comminution discharge conduit and having a coarse material output and a fine material output;

a high pressure roll press connected to receive output of coarse material from said classifier;

and a crushed product discharge leading from said roll press and connected to deliver respective portions of said crushed product to said supply means and to said comminution product discharge conduit so that one portion of said crushed product from said roll press is delivered back to said classifier and a remaining portion is delivered to said comminution mechanism.

2. The system of claim 1, including means for delivering hot gases to said material.

3. The system of claim 2, wherein said hot gas delivery means is connected to deliver heated gases to said stock prior to its passing to said comminution mechanism.

4. The system of claim 1, wherein said comminution mechanism is a hammer mill.

5. The system of claim 1, wherein said comminution product discharge is in the form of a vertical rising main extending between the comminution mechanism and said classifier.

6. The system of claim 1, including a metering conveyor weigher between said supply means and said comminution mechanism.

7. The system of claim 3, including a tube mill located between said roll press and said comminution product discharge whereby material from said roll mill passes through said tube mill and thereafter to said classifier.

8. The system of claim 1, including a separator connected to receive said fine material output from said classifier to separate said fine product out of a sifting gas stream leaving said classifier.

9. The system of claim 1, including means for delivering hot gas to said supply means for the heating of stock passing to the comminution mechanism and also connected to said comminution product discharge for heating the material prior to its delivery to said classifier.

10. A method of comminution and grinding a brittle grinding stock selected from the group consisting of initial material for raw cement meal, cement clinker and coal including damp initial materials, comprising the steps of:

comminuting an initial grinding stock;

delivering the comminuted material to a classifier and receiving a coarse material output and a fine material output;

delivering said coarse material from said classifier to a high pressure roll press;

delivering a portion of the output of said roll press to be comminuted and the remaining portion to be classified; and delivering heated gases to the at least initial grinding stock to remove the moisture therefrom.

11. The method of claim 10, wherein the hot gas is delivered to the material prior to comminution.

12. The method of claim 10, wherein the hot gas is delivered to the material after comminution and before said classifier.

13. The method of claim 10, wherein the hot gas is delivered to said fine material after it leaves said classifier.

14. An apparatus for comminuting, grinding and drying damp, brittle grinding stock selected from the group consisting of initial material for raw cement meal, ore and coal comprising:

an impact hammer mill having a closed floor, a product admission inlet and a product discharge outlet, said product admission inlet being supplied by product feed means and having hot gas injected therein, said product discharge outlet having a riser connected thereto in the form of a flow drier having a tube worm sluice, said riser leading to and being in connection with a sifter, said sifter having a discharge outlet for coarse product which is in communication with a delivery shaft of a high pressure roller press, said roller press having a discharge which leads directly to said riser.

15. The apparatus of claim 14, wherein said product discharge of said high pressure roller press is divided into two grain sizes, one of said two grain sizes being coarser than the other, the fine grain size being conducted directly from said discharge of said roller press to said riser and the coarse grain size being conducted from a further discharge of said roller press to said product admission inlet of said impact hammer mill.

16. The apparatus according to claim 15, further comprising a sub-stream conduit which branches off from said into the admission inlet of a tube mill, the discharge of said tube mill being capable of discharging into said riser.

17. The apparatus according to claim 14, further comprising a sub-stream conduit which branches off from said delivery shaft of said high pressure roller press which leads into the admission inlet of a tube mill, the discharge of said tube mill being capable of discharging into said riser.

* * * * *